US005685076A

United States Patent [19]

Curley et al.

[11] Patent Number: 5,685,076

[45] Date of Patent: Nov. 11, 1997

[54] METHOD OF CONSTRUCTING A COLLAPSIBLE STRUCTURE

[75] Inventors: Dennis M. Curley, Brea; Chris M. Boos, Studio City, both of Calif.

[73] Assignee: Southern California Foam, Inc., Brea, Calif.

[21] Appl. No.: 729,330

[22] Filed: Oct. 15, 1996

Related U.S. Application Data

[62] Division of Ser. No. 258,710, Jun. 13, 1994, Pat. No. 5,564,454.

[51] Int. Cl.[6] ..... B23P 11/00; A63H 30/00

[52] U.S. Cl. ..... 29/897.3; 29/448; 135/95; 446/486

[58] Field of Search ..... 29/897.3, 897.312, 29/446, 448, 525.01; 135/119, 137, 900, 902, 125, 126, 90, 95; 403/221, 229; 446/486, 487; 53/438; 52/651.04, 651.11, 646, 645; 112/418, 141

[56] References Cited

U.S. PATENT DOCUMENTS

| | | | |
|---|---|---|---|
| 2,545,556 | 3/1951 | Pont | 135/125 |
| 4,646,770 | 3/1987 | Labato | 135/900 |
| 4,945,584 | 8/1990 | LaMantia | 135/90 |
| 5,022,216 | 6/1991 | Muckenfuhs et al. | 53/438 |
| 5,339,851 | 8/1994 | Miller et al. | 135/125 |
| 5,502,927 | 4/1996 | Hammerton | 135/119 |

*Primary Examiner*—S. Thomas Hughes
*Assistant Examiner*—Tisa Stewart
*Attorney, Agent, or Firm*—Luke Santangelo

[57] ABSTRACT

A collapsible structure having front and back ends with front and back support members includes a single central support member to pass in a direct line along the cover and thus support the entire structure at roughly the center of the cover. The item may be sewn and easily manufactured in a fashion so that upon being collapsed it occupies the smallest possible volume and has no overlapping support members. Finally in pet toy applications crinkly material and washable material may be included.

19 Claims, 3 Drawing Sheets

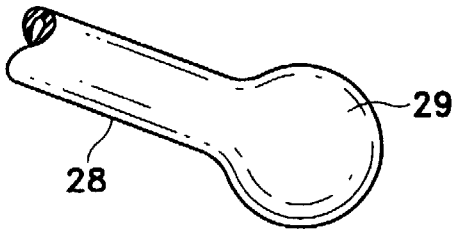
FIG. 7
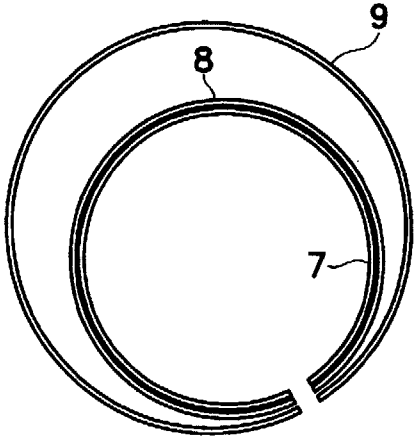
FIG. 10
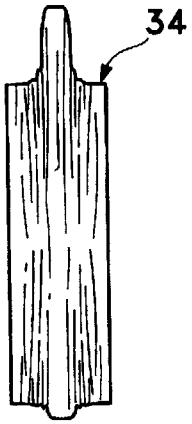
FIG. 9
FIG. 6
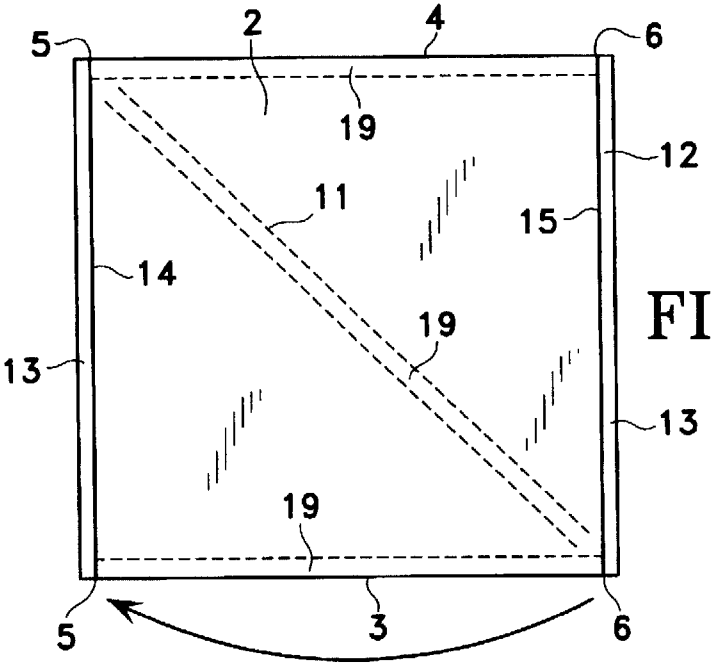
FIG. 8
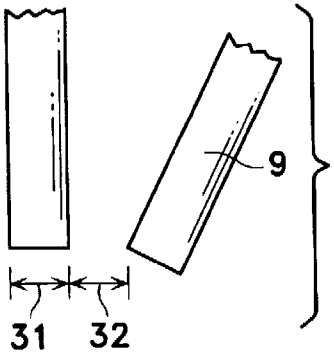

METHOD OF CONSTRUCTING A COLLAPSIBLE STRUCTURE

This application is a division of application Ser. No. 08/258,710, filed on Jun. 13, 1994. Now U.S. Pat. No. 5,564,454.

BACKGROUND OF THE INVENTION

Generally, this invention relates to collapsible structures such as toys and outdoor items such as tents and the like. Specifically the invention focuses upon a tunnel-oriented pet toy. It also relates to simple and economical methods to construct these types of items.

Collapsible tents, toys and other types of structures have been in use for a very long time. These devices come in a variety of designs which optimize certain features and allow uses in different manners. Since the items in use are designed to occupy a significant volume, an almost universal goal is to allow these structures to be collapsed to as minimum a volume as possible while having a great ability to maintain their shape in use. The present invention presents a design which allows an even greater degree of compression while also permitting erection of the item with virtually no need for user interaction.

In addition to widespread use of structures such as tents and the like, certain types of structures can be appropriate as a toy whether for children or pets. The present invention presents a design which is particularly suited for use in an entertainment context for small children and pets because the design is a completely economical design to construct. It also allows for easy integration of noise generating features such as a crinkly material in an economical manner.

One of the difficulties which previous designs have found challenging is adequate and economical support for the structure —particularly the center of the structure where a person or animal is most likely to need head room. Some designs, such as those shown in U.S. Pat. Nos. 3,675,667 and 3,960,161 achieve this only through tension which holds the cover material taut. Alternatively, in the latter of these two, center structural support is shown by combining two units back to back. As the present invention shows this requires unnecessary materials and supporting structure.

Another aspect which has been desirable has been complete compaction of the unit when not in use. As with the prior two designs several other designs such as those shown in U.S. Pat. Nos. 4,858,634, 3,848,615, 3,990,463, and 5,249,592 provide for compaction when not in use; however, in each of these the flexible structural support members overlap and thus cannot achieve as flat a package as desired.

Certainly as these referenced patents show, there have been a great variety of designs in tents and other structural things. Not many designs have approached the unique requirements of the toy field let alone the pet toy field. Regardless of the field of application, the present invention improves upon previous devices by allowing not only better collapsing when not in use but also by providing a more economical design to manufacture. Since the present invention makes use of materials and systems which have been known for years, it can be shown that true appreciation of the problems was not perhaps fully understood by those skilled in the art. While they had attempted to provide for collapsible units as several of the previous designs show in their figures, they had allowed the structural members to overlap and thus had unnecessarily required greater volume when collapsed. They had also not achieved as efficient a design as the present invention. To this extent each of the designs teaches away from the direction taken by the present invention.

SUMMARY OF THE INVENTION

Accordingly, the present invention provides an easily manufacturable and collapsible structure which has two end support members (front and back) and only a single central support member which extends from one corner to the opposite other corner. In traversing its path this central support member provides support close to the center of the item—at the point where it most needed. The design particularly accommodates easy manufacture as virtually all manufacture can be accomplished on a flat surface.

Thus it is a goal of the invention to provide an outdoor structure or toy which collapses to the smallest possible volume. In doing so one of the goals is to provide a design in which solid structural members need not overlap when collapsed.

Another goal of the invention is to provide an economical and simple design which is easy to construct, to use, and to make. With respect to making the device, a goal is to provide a device which may be made on a flat surface with no difficult sewing or cutting lines. Thus a goal is to minimize materials and labor. In use, a goal is to provide a device which requires virtually no interaction by the user. The device can therefore be uncollapsed and erected for use by even a small child.

In keeping with the object of using the structure as a toy for both small children and pets, another goal of the invention is to provide a structure which can be machine washed and yet which does not substantially support growth of mold and mildew.

It is also an object of the invention to have a design which can easily accommodate noise-making entertainment aspects whether used as a child's toy or a pet toy.

Naturally further objects of the invention are disclosed throughout other areas of the specification and claims.

BRIEF DESCRIPTION OF THE DRAWINGS

FIG. 6 is a flat view of a design shown in FIG. 1 prior to attachment along the seam.

FIG. 7 is a perspective view of a sealed end of one of the support members.

FIG. 8 is a top view of two ends of two different support members showing how they are positioned in relationship to each other.

FIG. 9 is a side view of a collapsed structure similar to that shown in FIG. 1.

FIG. 10 is a top view of only the support members of the collapsed structure shown in FIG. 9 to illustrate the positioning of the various members.

DETAILED DESCRIPTION OF THE PREFERRED EMBODIMENTS

Figure 1:
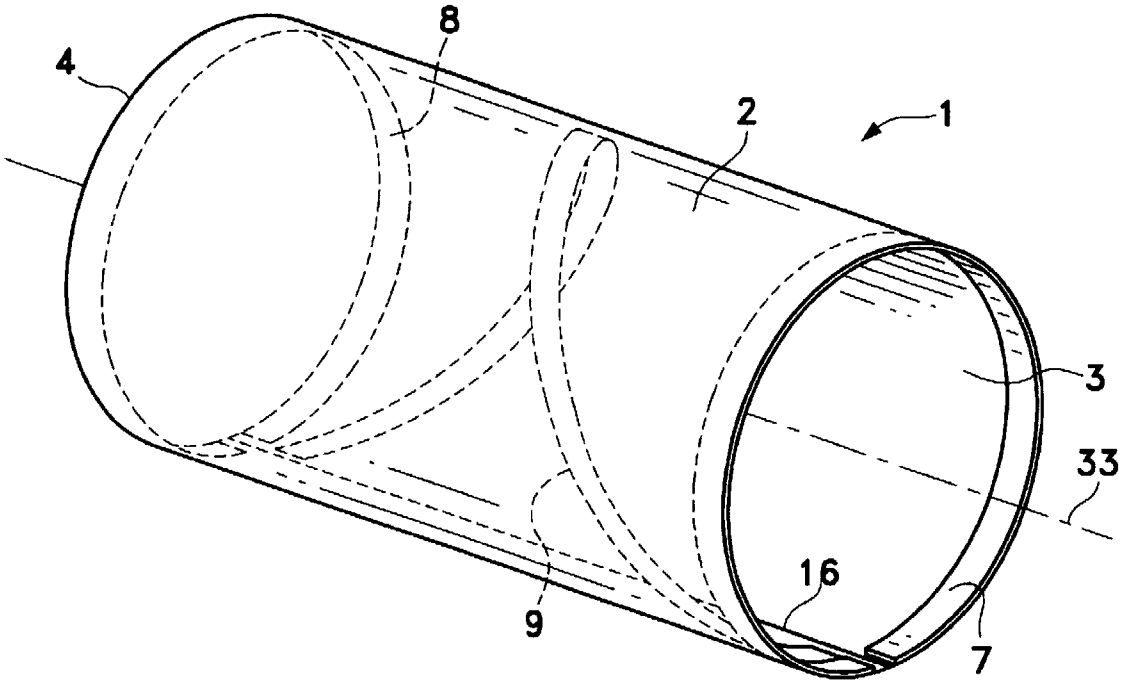
FIG. 1 is a perspective view of one embodiment of the invention showing a tunnel-oriented design.

As can be seen from the drawings the basic concepts of the invention can be accomplished in several ways. Referring to FIG. 1 it can be seen that a design according to the invention can result in structure (1). This shows a tunnel structure having two open ends. Alternatively, if one end of a tunnel design were closed, the item might naturally present itself in a bag or even bucket shape. Naturally both ends may be closed as could be easily understood (with or without a door). Basic components of structure (1) are collapsible cover means (2) and various support members. These support members are shown internally in FIG. 1 and include linear elastic front support (7), linear elastic back support member (8), and single linear elastic central support (9). Each support may be internal or external of course. As may be easily appreciated, these support members may be made of a variety of materials so long as they are elastic so that they can maintain the positions desired and yet still be collapsed. As may be appreciated from FIG. 2, linear elastic central support member (9) essentially achieves a spiral path as it traverses from front end (3) to back end (4) of structure (1). Naturally, the total length of the design according to the invention may be comprised of multiple sections of the structure (1).

Figure 3:
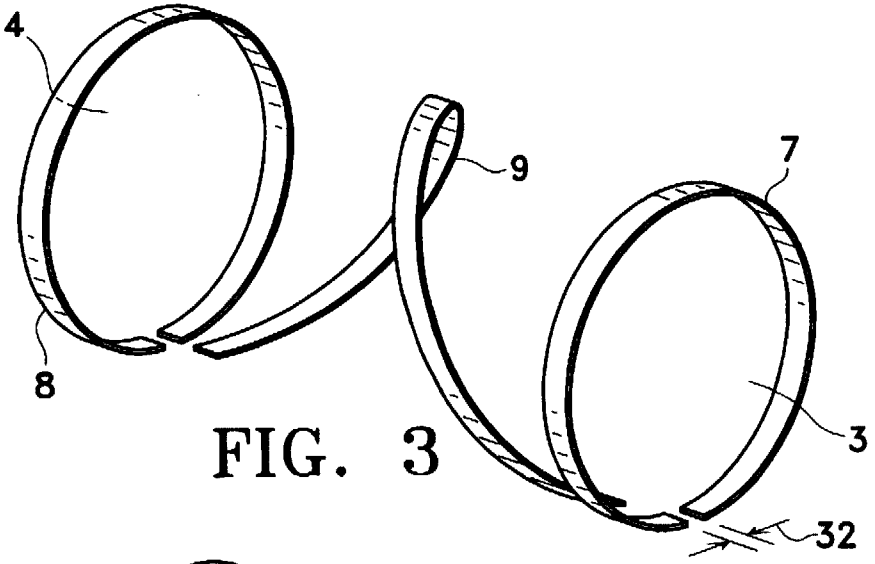
FIG. 3 is a perspective view similar to FIG. 1 showing only the structural components in the position they will assume when erected for use.

FIG. 3 shows the spiral path taken by linear elastic central support member (9) with all cover material removed. As can be seen linear elastic central support member (9) passes from the bottom of front end (3) through roughly the center of the cover means at the top end then again back to the bottom of back end (4). At roughly the center of collapsible cover means (2) linear elastic central support member (9) may be held in place by some item such as loop (18).

Figure 2:
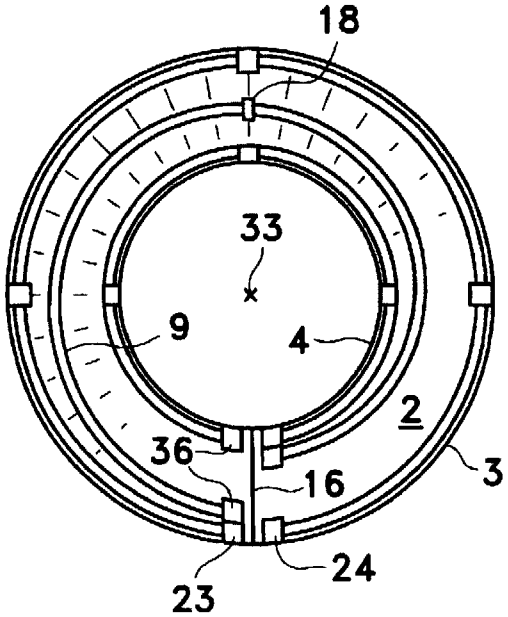
FIG. 2 is an end view of the same design in FIG. 1 showing the inner structural components of the device.
Figure 5:
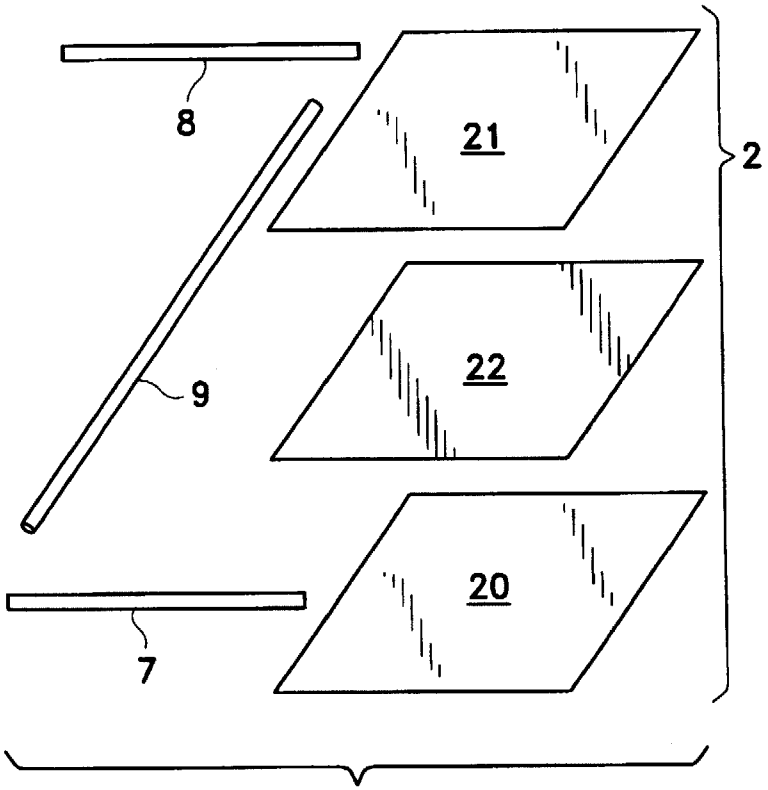
FIG. 5 is an exploded view of the elements which create the design shown in FIG. 1.

Referring to FIGS. 5 and 6 it can be seen how such a device can be easily made using one or more collapsible cover means (2). The support members can be sewn into or inserted into sheaths in cover means (2). Other attachment techniques are also possible. As shown in FIG. 6 cover means (2) can be sewn in a "Z" fashion and the support members may be inserted in place and even sewn shut for permanent attachment to the structure. Alternatively, as shown in FIG. 2 pockets (36) can be provided along with other types of attachment techniques. As shown in FIG. 6, sheaths (19) may be sewn through the use of straight line sewing on a flat surface. This simplifies manufacture.

As shown in FIG. 5, the entire device may be constructed of more than one material to create cover means (2). This can include inner material (20), outer material (21), and stiffer sheet material (22). When sewn together as shown in FIG. 6, these materials can make one cover means (2) which can be made on a flat surface. Thus each support member can have its own attachment means. Particularly, with respect to central support member (9), a central attachment means such as loop (18) (shown in FIG. 2) or sheath (18) (shown in FIG. 6) may be included at roughly the center of cover means (2). This holds central support member (9) in the proper position. It may be desirable to have support at roughly the center of cover means (2) to maximize head room or at least the volume available for use of structure (1).

Referring to FIG. 6, the entire manufacture of the device can be easily understood. Although the materials are shown as sewn together in FIG. 6, it should be understood that a great variety of attachment techniques could be used and still fall within the scope of the present invention. First the cover sheets may be attached by sewing along edges. This might be achieved from front end (3) to back end (4) (naturally front and back are relative only and arbitrarily set). Sewing can also be accomplished along left edge (14) and right edge (15). In the event sheaths (19) are desired, additional sewing can be achieved as shown. In FIG. 6 each of the sewing lines are shown as dotted lines to represent sewing (11). Either prior to any sewing or once sheaths (19) are sewn, the support members may be inserted. As shown in FIG. 6, front support member (7) runs from substantially first corner (5) of front end (3) to second corner (6) of front end (3). Similarly, back support member (8) runs from first corner (5) of back end (4) to second corner (6) of back end (4).

Significant to the invention is the fact that central support member (9) runs diagonally from one corner of the front end to the other corner of the back end. As shown in FIG. 6 sheath (19) for central support member (9) is shown running from second corner (6) of front end (3) to first corner (5) of back end (4). Additionally since it will ultimately be desired to restrain the support members in a curved position for a tunnel design, it may be desirable to have some sort of detachable attachment (12) along two opposite edges such as left edge (14) and right edge (15). As shown in FIG. 6 detachable attachment (12) may be actually velcro (13), snaps, or other types of devices. As explained later, the attachment of the edges may also be permanent such as a sewn seam.

In providing a diagonal central support member, central support member (9) is shown running from one edge to the other edge and thus will pass from left to right edges (or vice versa). Detachable attachment (12) serves to join left and right edges when using a design such as the tunnel structure (1) shown in FIG. 1. By providing sheath (19) or some other type of attachment means, cover means (2) is responsive to each support member. Further, naturally this responsiveness need not be along the entire length and indeed as shown in FIG. 2 only loop (18) is used. Similarly, sheath (19) might only be included along part of the length of each of the support members. Further, although sheath (19) is shown as entirely sewn to the material, it might also be made separate from the material as could be easily appreciated. Once manufactured as shown in FIG. 6, the detachable attachment (12) can be connected onto itself to create seam (16) and thus cause each of the support members to achieve a curved position. In this position it can be seen how elastic central support member (9) traverses in a direct line along cover means (2) even though that line is not a straight line when established for use. When not in use, detachable attachment (12) can be detached to achieve either a flat surface or, alternatively, each of the support members may be removed from cover means (2). Although this is not necessary, it can easily be accommodated. As shown in FIG. 2, there may be included a left front corner attachment means (23) and a right front corner attachment means (24). These may be things such as pockets (36) which allow the support members to be removed.

FIG. 8 shows the relationship of two adjacent ends of one end support member and central support member (9). As shown, each support member has width dimensions (31). Thus, by allowing the ends of the various support members to be at least one width dimension away, they will be allowed to move over the other one and thus not be restricted so as to cause any overlap when collapsed. By positioning the end of each member at least one width dimension away (32) from the other support member, collapsing can be achieved more efficiently. This is shown in FIGS. 9 and 10. FIG. 9 shows a side view of the device in a collapsed mode. An end view of this same design showing only the support members is shown in FIG. 10.

As can be appreciated, front support member (7) may position itself in a circular arrangement when collapsed. Since back support member (8) is roughly the same size, it can position itself roughly next to front support member (7)

with no overlap. Central support member (9) however may be longer than either front support member (7) or back support member (8). Thus when it achieves a roughly circular arrangement it will be larger than the others and will encircle the others. Although each support member is collapsed, it is shown in FIG. 10 how no support member overlaps the other and thus more flat collapsing is achieved. Thus even when support members are permanently attached (such as sewing entirely around the support member) they may still allow as flat a collapsed unit as possible. When collapsed as shown in FIGS. 9 and 10, the unit may be collapsed along central axis (33). It may also be further restricted by the use of a bag or tie and the like. Thus, the unit may be held in its compressed state (34) as shown in FIG. 9. When desired to be used, the unit simply needs to be unrestricted and it will immediately and automatically achieve its desired structure.

Figure 4:
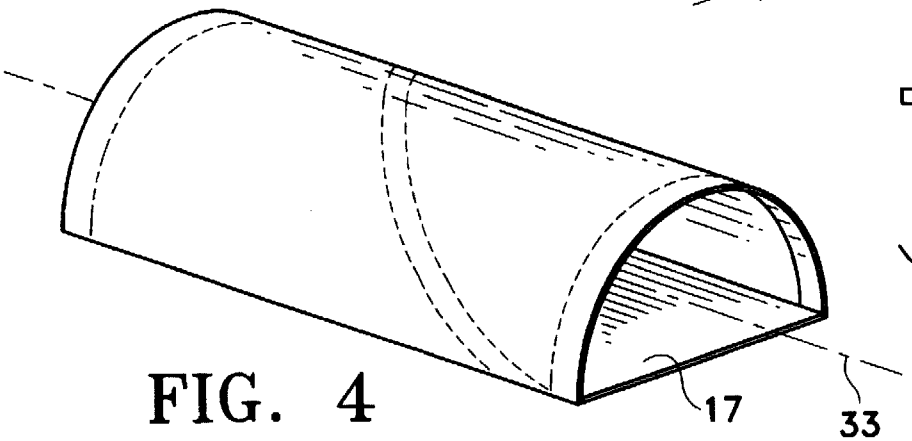
FIG. 4 is a tent-oriented design having a floor for use.

Referring to FIG. 4 it can be seen how different shapes may be achieved. By simply using floor (17) which may be attached from one attachment means (12) to the other attachment means (12), a semi-circular or other shape might be achieved. Thus, the unit can hold itself in a more tent-like shape if desired. Floor (17) as well as detachable attachments (12) or a permanent attachment of the edges can serve as some type of restraining means when combined with the cover means (2) along which the support members run. These restrain the support members into their curved position and allow the device to achieve the shape and volume desired through bending of the support members.

FIG. 7 shows an end of one support member. Although the support members may be made of a host of materials, if not made of something solid—that is using some type of hollow material —it may be desirable to seal the ends of the hollow material. This might be accomplished by plugging the item or, alternatively, it might be accomplished by separately sealing the ends through melting and the like. This is particularly helpful when washing or exposing to rain is possible. Thus, if a hollow item such as tubular rod (28) is involved it may include sealed ends (29).

Since the item is designed to be able to be used in both child toy and pet environments, it may be desirable to select materials which are washable and which do not tend to rust or the like. Thus while solid support elements may be too heavy they might be sealed on the ends. Further, the support materials may be flexible rods such as a polyolefin rod and the material of which cover means (2) is made may be material which can be simply inserted in the washing machine.

Referring to FIG. 5, the middle material (22) may actually be stiffer sheet material (22). This may even be a crinkly material which tends to make noise when used. This can be particularly appropriate for cats and the like. In selecting a material to be crinkly, it may be important that the material not permanently crease as it is possible for the item to remain collapsed for long periods of time. Markosite styrene film has been found to work very well.

Finally, it should be appreciated that a variety of different configurations are possible. Although as shown in FIG. 3 front, central, and back support members are separate items they might be made of a single loop. This loop would be continuous as it passed from, for instance, second corner (6) through first corner (5) of front end (3) and then back diagonally to form central support member (9) and then passing from first corner (5) of back end (4) through second corner (6) of back end (4). Naturally, this type of design would not tend to collapse in an optimum manner since some support members must overlap. However in some applications this may not pose any problems.

The foregoing discussion and the claims which follow describe preferred embodiments of the present invention. Particularly with respect to the claims, it should be understood that changes may be made without departing from the essence of the invention. In this regard it is intended that such changes will still fall within the scope of this patent. It is simply not practical to describe all the possible revisions and variations which may be accomplished.

We claim:

1. A method of constructing a collapsible structure comprising the steps of:

a. establishing a flat collapsible cover having front and back ends, each end having corresponding first and second corners;

b. attaching a linear elastic front support member to the cover and positioned to run from substantially the first corner of the front end to substantially the second corner of the front end along the cover while the cover is substantially flat;

c. attaching a linear elastic back support member to the cover to run from substantially the first corner of the back end to substantially the second corner of the back end along the cover while the cover is substantially flat; and d. attaching a single linear elastic central support member to the cover to run from substantially the second corner of the front end to substantially the first corner of the back end in a direct line along the cover while the cover is substantially flat;

e. bending each of the linear elastic support members; and f. restraining the linear elastic support members in a curved position.

2. A method of constructing a collapsible structure as described in claim 1 wherein said cover has a left edge running from the first corner of the front end to the first corner of the back end and a right edge running from the second corner of the front end to the second corner of the back end and wherein the step of restraining said linear elastic support members in a curved position comprises the step of detachably attacking the left and right edges of said cover.

3. A method of constructing a collapsible structure as described in claim 1 wherein said cover has a left edge running from the first corner of the front end to the first corner of the back end and a right edge running from the second corner of the front end to the second corner of the back end and further comprising the step of attaching a floor member having two edges along one of said floor edges to one edge of said cover and wherein the step of restraining said linear elastic support members in a curved position comprises the step of detachably attaching the other edge of the floor member to the other edge of said cover.

4. A method of constructing a collapsible structure as described in claim 1 wherein said cover has a left edge running from the first corner of the front end to the first corner of the back end and a right edge running from the second corner of the front end to the second corner of the back end and wherein the step of restraining said linear elastic support members in a curved position comprises the step of permanently attaching the left and right edges of said cover.

5. A method of constructing a collapsible structure as described in claim 1 wherein said cover has a left edge running from the first corner of the front end to the first corner of the back end and a right edge running from the second corner of the front end to the second corner of the back end and further comprising the step of permanently attaching a floor member having two edges along one of said floor edges to one edge of said cover and wherein the step of restraining said linear elastic support members in a curved position comprises the step of permanently attaching the other edge of the floor member to the other edge of the cover.

6. A method of constructing a collapsible structure as described in claim 1 wherein all support members have a width dimension and wherein the step of attaching said linear elastic front support member at the second corner of the front end is accomplished at a point at least the width dimension away from the end of said central support member attached at the second corner of the front end and wherein the step of attaching said linear elastic back support member at the first corner of the back end is accomplished at a point at least the width dimension away from the end of said central support member attached at the first corner of the back end.

7. A method of constructing a collapsible structure as described in claim 1 wherein the assembled structure has a central axis and further comprising the steps of:

a. compressing the structure along the central axis;

b. restricting the compressed structure along the central axis in its compressed state; and c. unrestricting the compressed structure along the central axis to allow its use.

8. A method of constructing a collapsible structure as described in claim 4 wherein the assembled structure has a central axis and further comprising the steps of:

a. compressing the structure along the central axis;

b. restricting the compressed structure along the central axis in its compressed state; and c. unrestricting the compressed structure along the central axis to allow its use.

9. A method of constructing a collapsible structure as described in claim 1 wherein each of the steps of attaching a support member comprise the steps of:

a. creating a plurality of sheaths which are attached to said cover, and b. inserting each support member into its own sheath.

10. A method of constructing a collapsible structure as described in claim 9 wherein the step of creating a plurality of sheaths comprises the step of attaching two covers together.

11. A method of constructing a collapsible structure as described in claim 1 and further comprising the step of affixing a third sheet material to said cover.

12. A method of constructing a collapsible structure as described in claim 11 wherein third sheet material comprises a stiffer sheet material.

13. A method of constructing a collapsible structure as described in claim 11 wherein third sheet material comprises a crinkly sheet of material.

14. A method of constructing a collapsible structure comprising the steps of:

a. establishing a flat collapsible cover having front and back ends, each end having corresponding first and second corners;

b. attaching a linear elastic front support member to the cover to run from substantially the first corner of the front end to substantially the second corner of the front end along the cover while the cover is substantially flat;

c. attaching a linear elastic back support member to the cover to run from substantially the first corner of the back end to substantially the second corner of the back end along the cover while the cover is substantially flat; and d. attaching a linear elastic central support member to the cover to run from substantially the second corner of the from end to substantially the first corner of the back end in a direct line along the cover while the cover is substantially flat;

e. bending each of the linear elastic support members so that when said first and second corner of said front support member are in proximity to each other and when said first and second corner of said back support member are in proximity to each other then said central support member rotates no more than one rotation from said second corner of said front end to said first corner of said back end; and f. restraining the linear elastic support members in a curved position.

15. A method of constructing a collapsible structure as described in claim 14 wherein said cover has a left edge running from the first corner of the front end to the first corner of the back end and a right edge running from the second corner of the front end to the second corner of the back end and further comprising the step of attaching a floor member having two edges along one of said floor edges to one edge of said cover and wherein the step of restraining said linear elastic support members in a curved position comprises the step of detachably attaching the other edge of the floor member to the other edge of said cover.

16. A method of constructing a collapsible structure as described in claim 14 wherein said cover has a left edge running from the first corner of the front end to the first corner of the back end and a right edge running from the second corner of the front end to the second corner of the back end and wherein the step of restraining said linear elastic support members in a curved position comprises the step of permanently attaching the left and right edges of said cover.

17. A method of constructing a collapsible structure as described in claim 14 wherein said cover has a left edge running from the first corner of the front end to the first corner of the back end and a right edge running from the second corner of the front end to the second corner of the back end and further comprising the step of permanently attaching a floor member having two edges along one of said floor edges to one edge of said cover and wherein the step of restraining said linear elastic support members in a curved position comprises the step of permanently attaching the other edge of the floor member to the other edge of the cover.

18. A method of constructing a collapsible structure as described in claim 14 wherein all support members have a width dimension and wherein the step of attaching said linear elastic front support member at the second corner of the front end is accomplished at a point at least the width dimension away from the end of said central support member attached at the second corner of the front end and wherein the step of attaching said linear elastic back support member at the first corner of the back end is accomplished at a point at least the width dimension away from the end of said central support member attached at the first corner of the back end.

19. A method of constructing a collapsible structure as described in claim 14 and further comprising the step of affixing a third sheet material to said cover.

* * * * *